United States Patent [19]

Otto et al.

[11] Patent Number: 4,509,027

[45] Date of Patent: Apr. 2, 1985

[54] CURRENT OPERATED MINIATURE RELAY

[75] Inventors: William C. Otto, Indianapolis, Ind.; Norman E. Daugherty, Elizabethtown, Ky.

[73] Assignee: E.M.B. Corporation, Elizabethtown, Ky.

[21] Appl. No.: 421,867

[22] Filed: Sep. 23, 1982

[51] Int. Cl.[3] ..... H01H 9/30

[52] U.S. Cl. ..... 335/201; 335/131

[58] Field of Search ..... 335/131, 155

[56] References Cited

U.S. PATENT DOCUMENTS

| | | | |
|---|---|---|---|
| Re. 26,172 | 3/1967 | Scheib | 335/131 |
| 2,569,776 | 10/1951 | Persons | 335/131 |
| 2,951,133 | 8/1960 | Davies et al. | 335/131 |
| 3,088,058 | 4/1963 | Jakel | 335/131 |
| 3,219,781 | 11/1965 | Miller et al. | 335/131 |
| 3,555,230 | 1/1971 | Deck | 335/201 |
| 3,980,978 | 9/1976 | Lacan | 335/201 |
| 4,045,751 | 8/1977 | Schuessler et al. | 335/201 |
| 4,199,740 | 4/1980 | Woods | 200/304 |
| 4,335,287 | 6/1982 | Aschenbach et al. | 200/67 G |

*Primary Examiner*—Peter S. Wong
*Assistant Examiner*—Jeffrey Sterrett
*Attorney, Agent, or Firm*—Robert F. Meyer

[57] ABSTRACT

A gravity/spring assisted electrical current operated relay has electrical terminals constructed integrally with electrical contact blades. Continuous build-up of conducting particles from the arcing of contacts is prevented through slots and protrusions built into the body of the relay. A recess is provided at the bottom of a cavity holding the armature for receiving foreign matter. Longitudinal ribs are provided along the walls of the cavity to prevent binding of the armature as it moves within the cavity. The ribs also provide a space for foreign matter. A holder is provided to receive an electrical terminal remote from the field coil.

6 Claims, 4 Drawing Figures

CURRENT OPERATED MINIATURE RELAY

BACKGROUND OF THE INVENTION

Generally speaking, the present invention relates to a gravity/spring assisted electrical current operated relay which comprises: a relay body having a top and bottom portion and a cavity therein, a magnetic coil carried by the body, an electrical contact and armature assembly slideably carried in the cavity and biased such that the armature rests on the bottom portion. The relay includes anti-tracking means disposed in the cavity to prevent electrically conductive paths from arc tracking within the cavity. In addition, there is a recess in the bottom of the cavity to receive unwanted foreign materials to permit the armature to rest on the bottom of the cavity. Guide means are provided in the cavity to prevent binding of the armature and to provide additional space to receive foreign matter. A holder is provided to receive electrical lead wires and terminals.

The present invention is directed to a current-operated relay for use in starting fractional horsepower single phase induction motors particularly in hermetically-sealed compressor motors used in the refrigeration industry.

Starting relays are designed to lift a steel armature by the magnetic pull of a coil. This armature mechanism raises a bar with contacts, to close the starting circuit between mating contacts. The electrical reliability of the contact depends upon the contact force. Such force is maintained by a spring which is compressed by the upward motion of the armature, as it seeks the center of the magnetic field created by the current in the relay coil. The relay armature pulls up at instant of start and closes the start motor winding. It drops out in a half second or so as motor reaches speed and running-winding current drops back.

When relays of this type are used in the refrigeration industry, they must of necessity be made very small and compact. This leads to many problems. For example, because of the miniature size of the relay, it is very difficult to maintain positive contact between the electrical contacts of the relay. In addition, because of the very small cavity within which the component parts of the relay must operate, arcing problems arise causing electrical conducting paths to be built up around the interior of the body. This, of course, causes many spurious arcing problems. Furthermore, because of the very small size of the cavity, particle buildup causes by wear presents a problem in the relationship of the armature to the field coil. In addition, binding of the armature as it moves within the small cavity presents a problem.

FEATURES OR OBJECTS OF THE INVENTION

It is, therefore, a feature of the present invention to provide a current operated relay of miniature overall size, using standard size parts in the relay. Another feature of the invention is to provide such a relay which includes anti-tracking means within the relay body to prevent formation of unwanted electrical conducting paths. Yet another feature of the invention is to provide such a relay wherein the armature spring maintains positive engagement between electrical contacts. Still another feature of the invention is to provide such a relay having a means to reduce the effect of unwanted particle buildup. Yet another feature of the invention is to provide such a relay having a means to prevent binding of the armature. And another feature of the invention is to provide such a relay having a means to carry an auxiliary electrical terminal remote from the relay's magnetic coil. These and other features of the invention will become apparent from the following description taken in conjunction with the accompanying drawings.

DETAILED DESCRIPTION OF THE INVENTION

Figure 1:
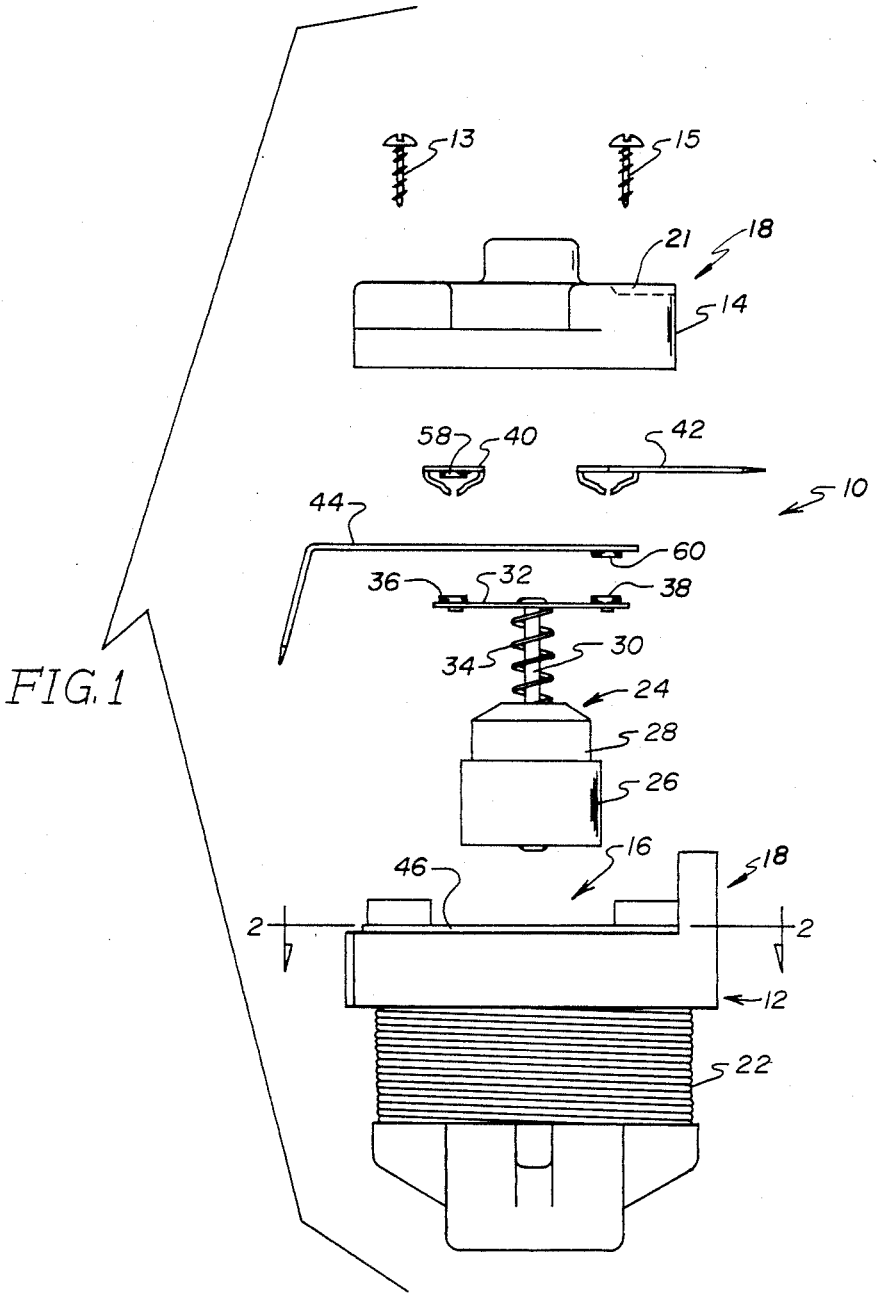
FIG. 1 is an exploded view of a relay employing the features of the invention.

Referring now to the drawings, there is shown a current operated relay 10 of the gravity/spring assisted type. The relay includes a body portion 12 which is closed by a cover 14, which is held in place by screws 13 and 15, to provide a cavity 16. A magnetic field coil 22 surrounds the body portion and consists of a plurality of turns of copper or aluminum wire. Electrical contact and armature assembly 24 floats or is slideably carried within the cavity 16. As shown, the assembly includes a magnetic steel armature 26, and a non-magnetic slug 28 that are carried on an eyelet 30, an electrical contact bar 32 that is loosely carried on the eyelet, and a coil spring 34 surrounding the eyelet and carried between the slug and the electrical contact bar. Electrical contact bar 32 includes a pair of electrical contacts 36 and 38.

Electrical terminals 40, 42 and 44 are carried on a platform 46 at the top portion of relay body 12. Terminals 40 and 42 are fitted into slots 48 and 50. Terminal 44 is carried in a slot 56 and is held in place by cover 14. As shown, electrical terminals 40 and 44 include electrical contacts 58 and 60. Terminal 42 serves as an electrical connection from the relay to a running winding of a motor. Terminal 44 connects to relay coil 22 through lead 62 in addition to carrying relay contact 60. Terminal 40 is connected to the start winding of the motor.

Figure 3:
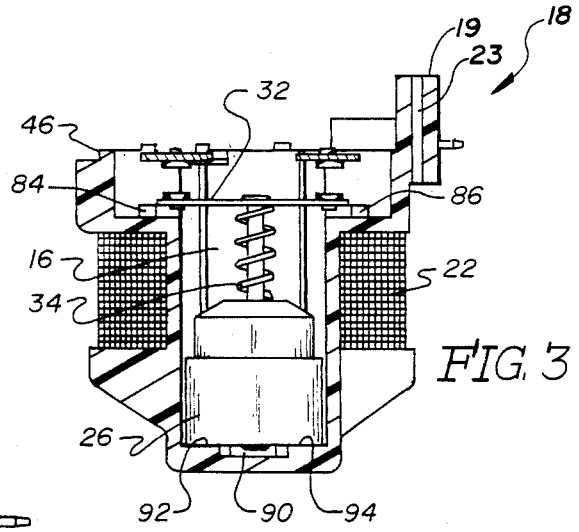
FIGS. 3 and 4 are sections taken along the line 3—3 of FIG. 2 showing different operating positions of the relay.
Figure 4:
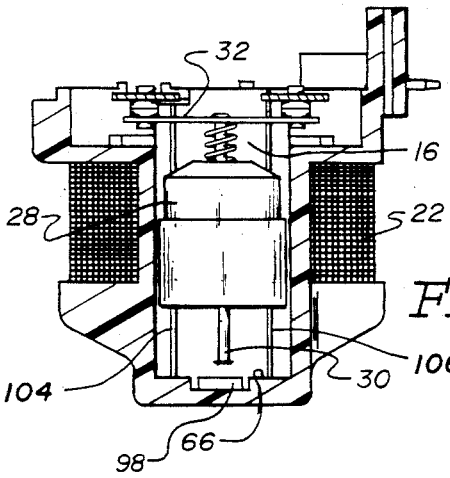

In operation, the armature is as shown in FIG. 3, at rest at the bottom of cavity 16. When AC electrical power is applied to the coil 22, a magnetic field is generated causing the armature to rise to seek the center of the coil and thereby force the electrical contact bar 32 to rise and as shown in FIG. 4 causes the electrical contacts to close. Pressure between the contacts is maintained by coil spring 34. Positive pressure between the contacts is aided by providing a spring having sufficient force to overcome the weight of the contact bar and still provide adequate contact pressure.

Figure 2:
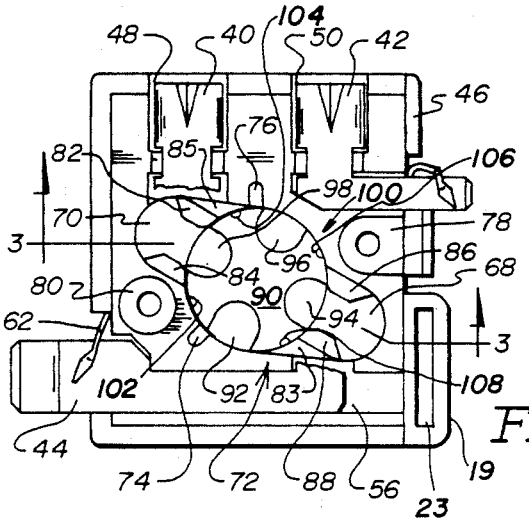
FIG. 2 is a view taken along the line 2—2 of FIG. 1.

Referring to FIGS. 2 and 3, electrical contact bar 32 lies in oppositely disposed recesses 68 and 70. The present invention contemplates the use of anti-tracking means 72 to prevent electrical paths from forming over the insulative surfaces of the recesses and the platform 46 that could occur when the electrical contacts are being closed. Anti-tracking means 72 includes slots 74 and 76 provided in the platform 46, bosses 78 and 80, and ledges 82, 84, 86 and 88 provided in the bottom of the recesses at one level, and ledges 83 and 85 at another higher level. The slots, bosses and ledges interrupt the insulative surfaces to prevent buildup of conductive particles from arcing of the electrical contacts sufficient to prevent electrically conductive paths from arc-tracking over the insulative surfaces which cause electrical breakdown around the contacts or between contacts and assembly screws 13 and 15.

Another problem associated with a miniature relay of this type is the criticalness due to the small difference in operating currents of the relay. In relays of this type, there is of necessity, a small differential between pull in value of the current and the lesser drop out value. The problem of operating within this narrow range becomes even more severe when the fluctuations normally appearing in line voltages are considered. Under these circumstances, it is imperative that the distance between the armature at rest and the coil be strictly maintained. For example, if the armature becomes too close to the coil, the magnetic forces of the coil will be pulled in to close the contact at less current. And in addition, the drop out current may not be reached. This causes cycling on the overload which causes serious operational problems. In the present relay, with its miniature size, foreign particle buildup due to material wear contributes to the problem by altering the distance between the armature and the coil. Such buildup has been prevented through a recess 90 which is provided by lands 92, 94, 96 and 98 in the bottom of cavity 16 and which also provide the base 66 of cavity 16.

Binding of the armature as it moves within the cavity is prevented by guide means 100 (FIG. 2). Guide means 100 includes a plurality of ribs 102, 104, 106 and 108 which extend longitudinally the length of cavity 16 and which guide the armature as it moves in the cavity. The ribs also provide a space between the armature and the cavity wall for receiving foreign matter.

A holder 18 carries an auxiliary electrical terminal remote from coil 22. Holder 18 includes a sleeve 19 adjacent to a cavity 21 in cover 14 (FIG. 1). The head of a spring clip type terminal (not shown) can be held in cavity 21 and the other end bent over and interference fitted into slot 23 of the sleeve.

What is claimed is:

1. A gravity/spring assisted electrical current operated relay comprising:

(a) a relay body and a cavity therein, (b) a magnetic coil carried by said body, (c) an electrical contact and armature assembly slideably carried in said cavity, and (d) anti-tracking means disposed in said cavity preventing electrically conductive paths from arc tracking over electrically insulating surfaces of said cavity including slots provided in said electrically insulating surfaces and projections extending from said electrically insulating surfaces.

2. A relay according to claim 1 further including a recess in a base of said cavity.

3. A relay according to claim 2 wherein said recess is formed by a plurality of lands projecting from said base.

4. A relay according to claim 1 wherein said projections include ledges extending from said electrically insulative surfaces.

5. A relay according to claim 1 wherein said projections include bosses extending from said electrically insulative surfaces.

6. A relay according to claim 1 further including guide means disposed within said cavity guiding said armature assembly in said cavity.

* * * * *